US005437385A

United States Patent [19]

Fillon

[11] Patent Number: 5,437,385

[45] Date of Patent: Aug. 1, 1995

[54] LIDS WITH CAMS FOR CLOSING A POT OF PAINT AND SIMILAR APPLICATIONS

[75] Inventor: Sylvain Fillon, La Boissière Ecole, France

[73] Assignee: Fillon Pichon S.A., Faveroles, France

[21] Appl. No.: 271,413

[22] Filed: Jul. 6, 1994

[30] Foreign Application Priority Data

Jul. 6, 1993 [FR] France ..... 93 08255

[51] Int. Cl.[6] ..... B65D 51/22

[52] U.S. Cl. ..... 220/238

[58] Field of Search ..... 220/238, 235, 234, 237, 220/DIG. 32, DIG. 33

[56] References Cited

U.S. PATENT DOCUMENTS

| | | | |
|---|---|---|---|
| 2,585,334 | 2/1952 | McCauley . | |
| 3,982,656 | 9/1976 | Kusmierski et al. | 220/238 |
| 4,567,994 | 2/1986 | Hofmann | 220/238 |
| 4,930,657 | 6/1990 | Walker | 220/238 |

FOREIGN PATENT DOCUMENTS

| | | |
|---|---|---|
| 0261996 | 3/1988 | European Pat. Off. . |
| 0323531 | 7/1989 | European Pat. Off. . |

*Primary Examiner*—Joseph Man-Fu Moy
*Attorney, Agent, or Firm*—Robert W. Becker & Associates

[57] ABSTRACT

The lid with cams for closing a pot or paint etc. has an underside provided with a seal to be clamped against an edge of a rim of the pot by pivoting the cams on the underside of the lid with levers placed on the top side of the lid. At least the rim is coated inside with a friction-sensitive, corrosion-protective material. Each of the cams is connected to the respective lever with a spindle. A spring biases this spindle, and thus the cam, in an upward direction. Each cam is maintained at a distance from the bearing surface of the rim in every positions of the cam except a position in which the cam extends outwardly from the lid (closing position) so as to protect the friction-sensitive corrosion-protective coating of the rim from abrasion.

6 Claims, 3 Drawing Sheets

LIDS WITH CAMS FOR CLOSING A POT OF PAINT AND SIMILAR APPLICATIONS

FIELD OF THE INVENTION

The invention relates to a lid with cams for closing a pot of paint and for similar applications.

BACKGROUND OF THE INVENTION

Pots, in particular pots containing paints, which are provided with removable lids including a stirrer, have been known for a long time.

The removable lids most often are fixed to the pots by cams which can be actuated from the exterior of the lid by means of a lever.

The cams are pivoted inside the pot in order to be applied more or less firmly against a bearing surface formed by the underside of a rim at the top of the pot.

Certain products, in particular paints with an aqueous solvent, may cause corrosion of the metallic pots currently used in the art. In order to remedy this disadvantage, the pot manufacturers usually apply a coating in the form of a varnish or other similar protective products to the inner wall of the pot and the rim.

This type of protection is satisfactory , but it happens that lids with a cam closure will deteriorate the bearing surface of the rim of the pots by abrasion of the protective coating (i.e., the protective coating, in general, is friction-sensitive and easily abraded) since the cams rub strongly against the bearing surface at the moment of closing the pot with the result that corrosion will appear.

It is an object of the present invention to provide a solution to the hereabove described problem.

SUMMARY OF THE INVENTION

The lid for closing a container according to the present invention is primarily characterized by:

an underside and a top side;

a seal, connected to the underside, for sealingly abutting against an upper edge of a rim of a container when the container is closed by the lid, wherein the rim of the container is provided with a friction-sensitive, corrosion-protective coating and wherein the rim has a downwardly facing bearing surface;

cams pivotably connected to the underside;

a lever for each cam, the lever connected to the top side for pivoting the cam;

the lever comprising a spindle connected to the cam;

the lever further comprising a spring for biasing the spindle and the cam into an upward clamping position for closing the container, in which clamping position the cam rests at the bearing surface of the rim and presses the seal against the upper edge;

a means for maintaining the cam at a distance from the bearing surface of the rim in any position of the cam but the clamping position of the cam such that the cams apply a compressive force to the bearing surface only in the clamping position;

the means comprising a ring connected to the underside of the lid; and the ring having a notch extending radially with respect to the lid for engaging the cam in the clamping position.

Preferably, the cam has a top in the shape of a wedge for engaging the notch of the ring. The top of the cam rests at the bearing surface only when the cam engages the notch.

Advantageously, the spring biases the cam such that a top of the cam rests at a bottom surface of the ring.

Expediently, the underside of the lid has an upwardly projecting boss and the lever has an integral sleeve with a closed top, wherein the spring has a first end abutting at the closed top and a second end abutting at the upwardly projecting boss.

The seal is preferably a flat, areal seal for sealingly resting on the upper edge of pots of varying diameters. The cams advantageously have a length so as to compensate for the varying diameters of the pots.

Various other features of the invention will become more apparent from the following detailed description.

BRIEF DESCRIPTION OF THE DRAWINGS

Embodiments of the invention are shown, by way of non-limiting examples, in the accompanying drawings, in which.

DETAILED DESCRIPTION OF THE PREFERRED EMBODIMENT

Figure 1:
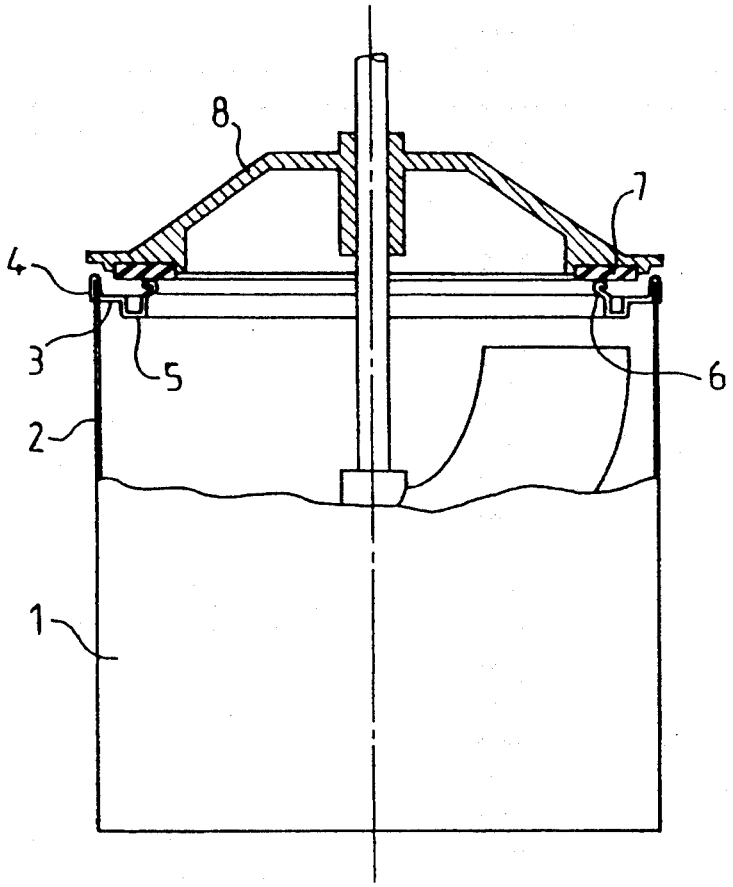
FIG. 1 is a diagrammatical, partly cross-sectional and elevational, view of the cam lid placed on a pot of paint.

FIG. 1 shows a pot 1 for containing a liquid or pasty product, such as, for example, paint. The pot 1 has a sidewall 2 of radial symmetry, most often of a cylindrical shape, made of a metal or possibly a synthetic material.

The sidewall 2 of the pot 1 has a top portion with a rim 3, which is, for example, crimped as shown at 4. The rim 3 defines a bearing surface 5 facing the bottom of the pot 1 and an upper edge 6 on which a flat, areal seal 7 of the lid 8 rests.

The rim 3 is made of metal, for example tin-plated iron.

At least the side of the rim 3 which is turned toward the inside of the pot 1 is coated with a varnish for protecting the metal of the rim 3 from corrosion (corrosion-protective coating) which corrosion can be caused by the product contained in the pot 1, in particular when the product is a paint with an aqueous solvent. The inner wall of the pot 1 is also coated with a varnish when this inner wall is also made of metal, in particular tin-plated iron.

In order to conveniently place the lid 8 on the upper edge 6, the lid 8 is advantageously provided with lateral pins 9, protruding downwardly and adapted for extending sideways with respect to the crimp 4 of the lid 8.

In a manner known in the art, the lid 8 is provided with a stirrer 10, for example in the shape of a helix which is mounted on a shaft 11 driven by a coupling 12 being, in turn, driven by a motor (not shown).

The lid 8 includes on its top side 8*b* a pouring spout 13 closed by a butterfly valve 14 which can be displaced by a release 15.

In order to latch the lid 8 on the pot 1, the underside 8*a* of the lid 8 is provided with cams 16 which can each be operated by a lever 17.

The lid 8 is provided with at least two cams 16; the number of cams may increase as a function of the diameter of the pot 1, and consequently of the diameter of the lid 8.

Figure 7:
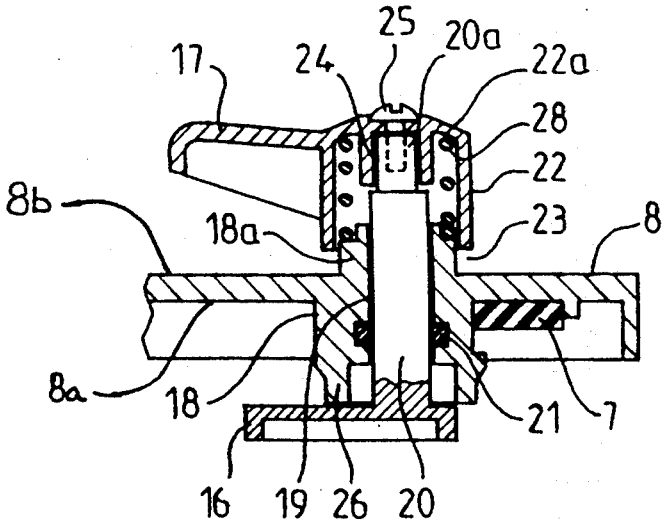
FIG. 7 is a cross-sectional view taken along line VII—VII of FIG. 3.
Figure 2:
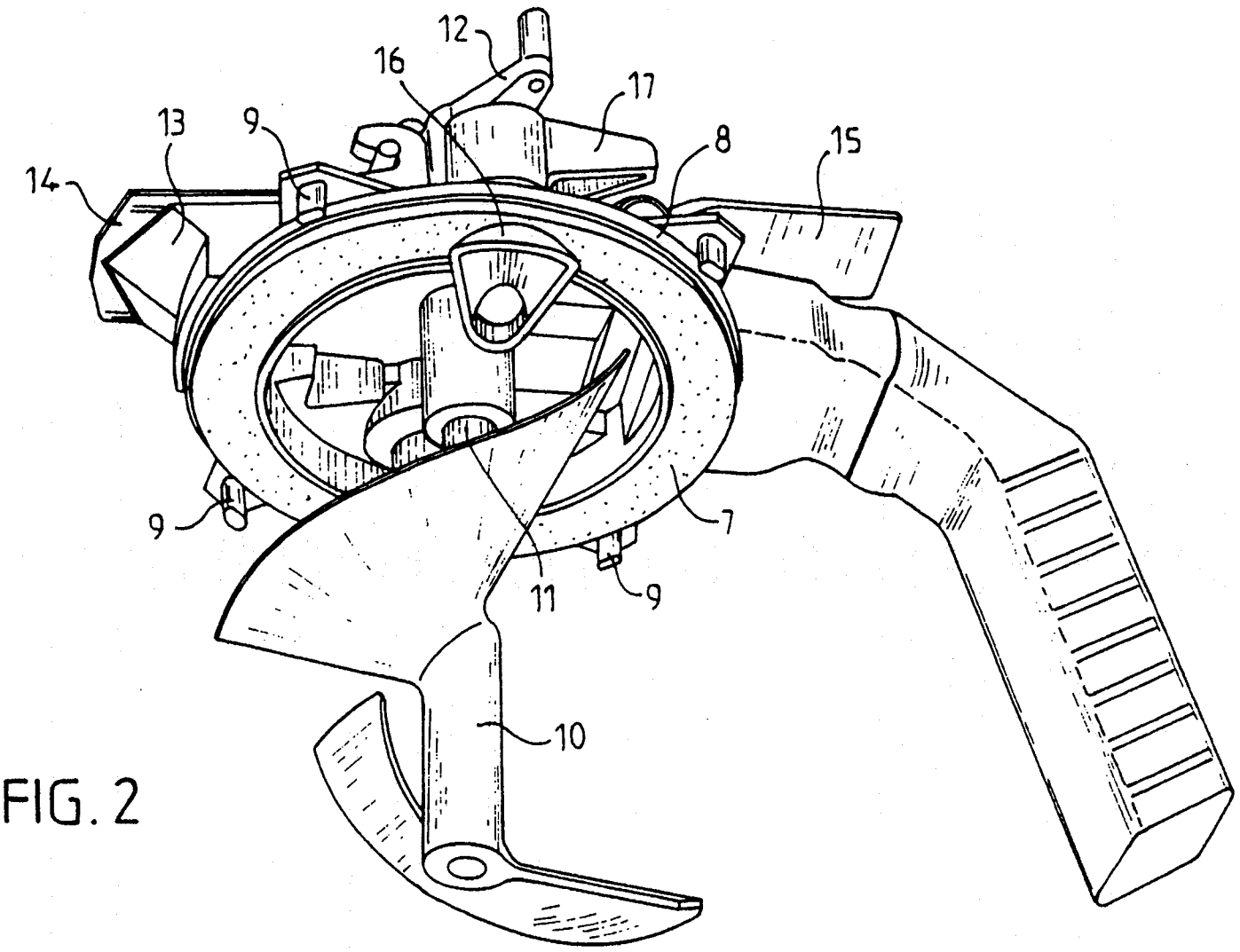
FIG. 2 is a three quarter perspective view of the underside of the lid of FIG. 1.

FIG. 7 shows that the lid 8 is formed, adjacent to the seal 7, with inner bosses 18, each defining a bore 19 for guiding a spindle 20.

An 0-ring or similar means 21 is interposed between the bore 19 and spindle 20. Each boss 18 projects upwardly past the lid 8, as shown at 18*a*, and is used as a bearing surface for a compression spring 28 surrounded by a sleeve 22. The sleeve 22 also surrounds the projection 18*a* while leaving optionally a free space 23 between its base and the top side 8*b* of the pot 8.

The sleeve 22 includes a closed top 22*a* against which abuts a free end of the spring 28. A sleeve 24 is formed from the closed top 22*a* and is threaded and keyed onto the end 20*a* of the spindle 20.

In order to simplify the manufacture, it is advantageous that the end 20*a* has a polygonal cross-section, for example, a square cross-section, and is complementary to the cross-section of the sleeve 24.

Preferably, the sleeve 24, sleeve 22 and lever 17 are made integrally of a synthetic material by molding.

A screw 25 or other similar member provides for fixation of the sleeve 22 on the spindle 20.

The free end of the spindle 20 is fixed to the cam 16, or preferably the spindle 20 and cam 16 are made integrally of a metal alloy by molding. For example, a ZnAl alloy can be used which can be coated with a protective layer, for example, by nickel plating or chromium plating.

Figure 5:
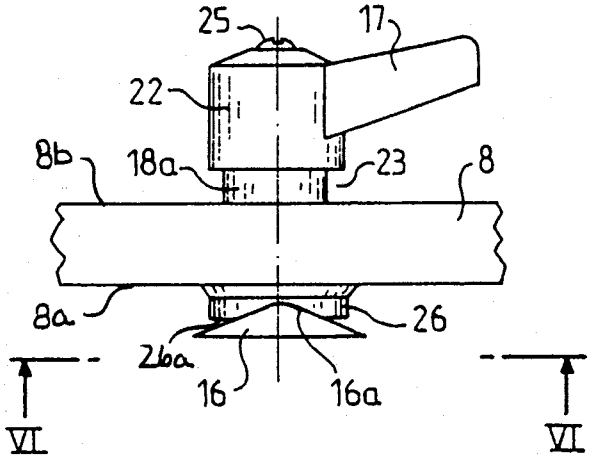
FIG. 5 is an elevational view similar to FIG. 3 showing the cam in the closing position of the lid.
Figure 6:
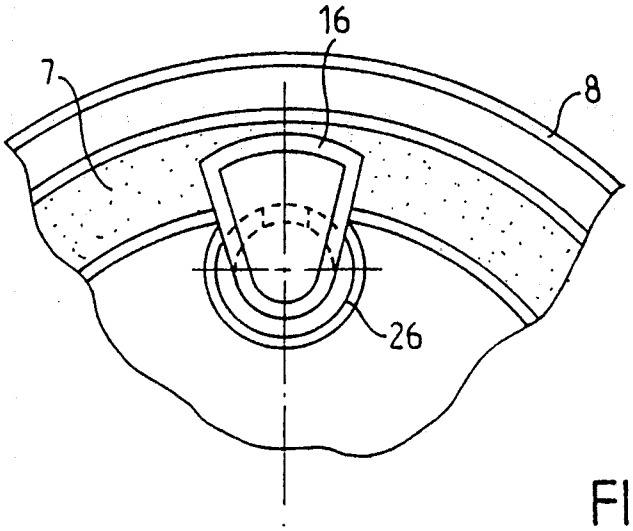
FIG. 6 is a partial plan view taken along line VI—VI of FIG. 5.
Figure 4:
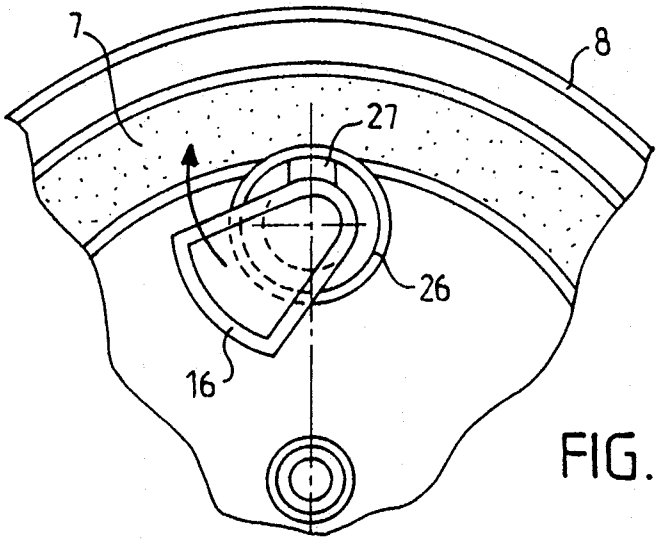
FIG. 4 is a partial plan view, taken along line IV—IV of FIG. 3.

FIGS. 4 and 6 show that each cam 16, when seen in a plan view, has substantially the shape of a circular sector, and FIG. 5 shows that the top 16*a* of this cam 16 has the shape of a wedge, i.e., is vaulted.

Figure 3:
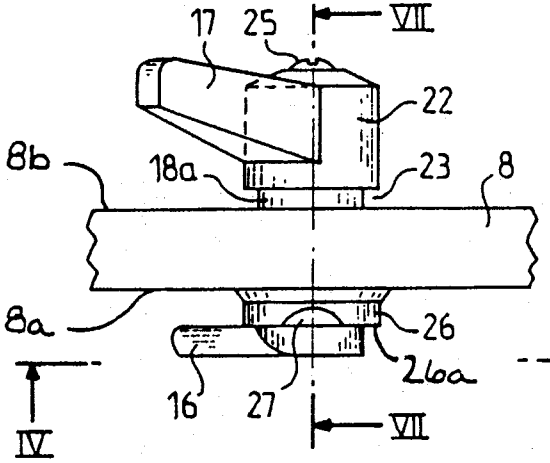
FIG. 3 is a partial elevational view showing one of the closing cams in the position enabling the removal of the lid.

The boss 18, inside which the spindle 20 is journalled, is extended by a ring 26 that has a radially extending notch 27, as shown in FIGS. 3 and 4.

When the lid 8 is removed from the pot 1, the lever 17 of each cam 16 is rotated in a direction such that the cam 16 is turned towards the center of the lid 8 while bearing on the bottom surface 26*a* of the ring 26. This position is shown in FIGS. 3 and 4.

In order to position the lid 8 and latch it on the pot 1, the lid 8 is placed while being guided by the side pins 9 such that the seal 7 will bear on the edge 6. Since the seal 7 is flat, it compensates for possible differences in the diameter of the edge 6, which is often the case depending on where the pots 1 have been manufactured.

In this position, the top of the cam 16 is in a plane parallel to the plane defined by the bearing surface 5 of the rim 3, but below the rim 3.

By pivoting the levers 17 (as indicated by the arrow in FIG. 4), the cams 16 glide along the bottom surface of their respective rings 26 until each cam 16 is received in the respective notch 27 whereby, under the action of the spring 21, which has a tendency to expand, the spindle 20 and cam 16 are lifted and the cam 16 is secured in the notch 27 (clamping position).

During rotation of the cams 16, the cams 16 are not in contact with the bearing surface 5 of the rim 3, thereby avoiding any abrasion of the friction-sensitive varnish on the bearing surface 5. The cams thus exert only a compression force on the varnish of the bearing surface 5 when in the clamping position; they do not exert a destructive frictional force during rotation since they are spaced from the bearing surface 5 when not in the clamping position. The length of the cams 16 allows for compensation of possible differences in diameter of the bearing surface 5 (for example, manufacturing tolerances).

The invention is not restricted to the embodiments shown and described in detail, and various modifications can be carried out without departing from the scope of the accompanying claims. In particular, the shape of the rim 3 can be different than that shown by way of example in the above figures and, likewise, the axial (upward) movement which is imparted to the cams 16 during closing can be provided in another way than via a ring 26 and notch 27. It is actually possible to form a ramp inside the boss 18 for a finger or to provide a thread that would engage the spindle 20.

The present invention is, of course, in no way restricted to the specific disclosure of the specification and drawings, but also encompasses any modifications within the scope of the appended claims.

What I claim is:

1. A lid for closing a container, said lid comprising:

an underside and a top side;

a seal, connected to said underside, for sealingly abutting against an upper edge of a rim of a container when the container is closed by said lid, wherein the rim of the container is provided with a friction-sensitive, corrosion-protective coating and wherein the rim has a downwardly facing bearing surface;

cams pivotably connected to said underside;

a lever for each said cam, said lever connected to said top side for pivoting said cam;

said lever comprising a spindle connected to said cam;

said lever further comprising a spring for biasing said spindle and said cam into an upward clamping position for closing the container, in which clamping position said cam rests with an upper side thereof at said bearing surface of the rim and presses said seal against the upper edge; and a means for spacing each said cam from said underside such that said upper side of said cam is positioned below said bearing surface of the rim in any position of said cam but said clamping position of said cam and such that said cams are pivoted in a plane below and parallel to said bearing surface and apply a compressive force to said bearing surface only in said clamping position.

2. A lid according to claim 1, wherein:

each said cam has a top in the shape of a wedge for engaging said notch of said ring; and said top of said cam rests at the bearing surface only when said cam engages said notch.

3. A lid according to claim 1, wherein said spring biases said cam such that a top of said cam rests at a bottom surface of said ring.

4. A lid according to claim 3, wherein:

said underside of said lid has an upwardly projecting boss;

said lever has an integral sleeve with a closed top; and said spring has a first end abutting at said closed top and a second end abutting at said upwardly projecting boss.

5. A lid according to claim 1, wherein said seal is a flat, areal seal for sealingly resting on the upper edge of pots of varying diameters and wherein said cams have a length so as to compensate for the varying diameters of the pots.

6. A lid for closing a container, said lid comprising:

an underside and a top side;

a seal, connected to said underside, for sealingly abutting against an upper edge of a rim of a container when the container is closed by said lid, wherein the rim of the container is provided with a friction-sensitive, corrosion-protective coating and wherein the rim has a downwardly facing bearing surface;

cams pivotably connected to said underside;

a lever for each said cam, said lever connected to said top side for pivoting said cam;

said lever comprising a spindle connected to said cam;

said lever further comprising a spring for biasing said spindle and said cam into an upward clamping position for closing the container, in which clamping position said cam rests with an upper side thereof at said bearing surface of the rim and presses said seal against the upper edge;

a ring for each said cam connected to said underside for spacing each said cam from said underside such that said upper side of each said cam is positioned below said bearing surface of the rim in any position of said cam but said clamping position of said cam; and said ring having a notch extending radially with respect to said lid, wherein said cam is pivoted in a plane below and parallel to said bearing surface and upon engaging said notch is biased upwardly by said spring to reach said clamping position so that said cam applies a compressive force to said bearing surface only in said clamping position.

* * * * *